US006518925B1

(12) United States Patent
Annamaa et al.

(10) Patent No.: US 6,518,925 B1
(45) Date of Patent: Feb. 11, 2003

(54) MULTIFREQUENCY ANTENNA

(75) Inventors: Petteri Annamaa, Oulu (FI); Jyrki Mikkola, Oulu (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/611,063

(22) Filed: Jul. 6, 2000

(30) Foreign Application Priority Data

Jul. 8, 1999 (FI) ..... 991569

(51) Int. Cl.[7] ..... H01Q 1/24
(52) U.S. Cl. ..... 343/702; 343/901
(58) Field of Search ..... 343/702, 700 MS, 343/901; H01Q 1/24

(56) References Cited

U.S. PATENT DOCUMENTS

| | | | | |
|---|---|---|---|---|
| 5,311,201 A | | 5/1994 | Lillie et al. | |
| 5,327,151 A | | 7/1994 | Egashira | |
| 5,389,938 A | * | 2/1995 | Harrison | 343/702 |
| 5,943,021 A | | 8/1999 | Hayes et al. | |
| 6,011,516 A | * | 1/2000 | Minegishi et al. | 343/702 |
| 6,262,693 B1 | * | 7/2001 | Sutter et al. | 343/895 |

FOREIGN PATENT DOCUMENTS

| | | | |
|---|---|---|---|
| EP | 0 443 088 A3 | 8/1991 | H01Q/5/00 |
| EP | 0 772 255 A1 | 5/1997 | H01Q/9/04 |
| WO | WO 98/44587 | 10/1998 | H01Q/9/04 |

* cited by examiner

*Primary Examiner*—Hoanganh Le
(74) *Attorney, Agent, or Firm*—Darby & Darby

(57) ABSTRACT

The invention pertains to an antenna construction of at least two frequency bands comprising at least a whip antenna. A dielectric block (33) with a relatively high permittivity is installed into the whip antenna (32) at a location in which there is a voltage maximum at a harmonic of the basic resonance frequency of the antenna. The dielectric medium shifts the harmonic in question downwards. The arrangement is realized in such a manner that the basic resonance frequency of the whip antenna falls on the operating frequency band of one network, and the harmonic in question falls on the operating frequency band of a desired second network. The construction may further comprise a PIFA antenna (34) the operating frequency of which is the same as the upper operating frequency of the whip antenna. Thus the degradation of the function of the PIFA that can be caused by the user's hand will not substantially degrade the connection since the whip, too, operates in the operating frequency band of the PIFA.

6 Claims, 2 Drawing Sheets

MULTIFREQUENCY ANTENNA

Figure 1:
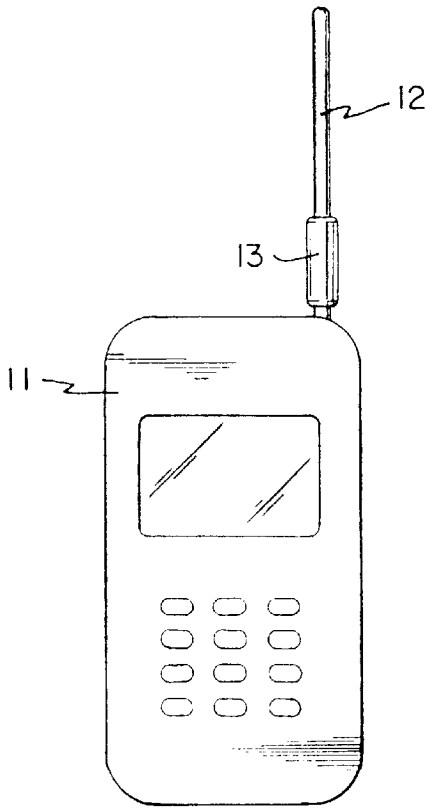

The invention relates to a whip antenna construction having at least two operating frequency bands.

In the world there are cellular communication systems in use that differ from each other significantly in their operating frequency bands. As regards digital cellular systems, the Global System for Mobile telecommunications (GSM) uses frequencies in the 890–960-MHz band, while the Digital Cellular System (DCS 1800) operates at band around 1800 MHz. The operating frequencies of the Japanese Digital Cellular (JDC) system are around 800 MHz and 1500 MHz. The Personal Communication Network (PCN) uses frequency band 1710–1880 MHz, and the Personal Communication System (PCS) frequency band 1850–1990 MHz;. The operating frequencies of the Digital European Cordless Telephone (DECT) system are 1880–1900 MHz. Frequencies in excess of 2000 MHz will be used in new third-generation cellular systems, such as the Universal Mobile Communication System (UMTS). From the user's perspective it would be desirable that he could use one and the same "standard phone" in these networks if he so wants. A first prerequisite for that is that the antenna of the communications apparatus functions relatively effectively in the frequency bands of more than one network.

Mobile communications apparatus use various antenna constructions, such as e.g. whip antennas, cylindrical coil or helix antennas and planar inverted-F antennas (PIFA). The resonance frequency of an antenna is determined on the basis of its electrical length, which is advantageously $\lambda/2$, $3\lambda/8$, $5\lambda/8$ or $\lambda/4$, where. $\lambda$ is the wavelength applied. Thus, one and the same basic antenna has in principle several frequency bands that can be used. The drawback, however, is that these frequency bands seldom falls on the bands of the two desired networks. From the prior art it is also known different combined antennas that can function in two frequency ranges: a combined helix and whip antenna, and a combined PIFA and whip antenna, for example. In these solutions the whip antenna, when pulled out, functions at the lower operating frequency and the other part of the antenna construction functions at the upper operating frequency. The disadvantage of the helix-whip combination is the protrusion caused by the helix part which is inconvenient when the communications apparatus is placed in a pocket, for example. The disadvantage of the PIFA-whip combination is that the user's hand may almost completely cover the PIFA, located inside the housing of the phone, thus considerably degrading the operation of the PIFA.

An object of this invention is to reduce said disadvantages of dual-frequency antennas according to the prior art.

The antenna according to the invention is characterized by what is expressed in the independent claim. Preferred embodiments of the invention are presented in the other claims.

The basic idea of the invention is as follows: A dielectric block with a relatively high permittivity is added to the whip antenna, at a point where there is a voltage maximum at a harmonic frequency of the basic resonance frequency of the antenna. The dielectric medium causes the harmonic frequency in question to shift downwards. The arrangement is realized such that the basic resonance frequency of the whip antenna falls on the operating frequency band of one network and the harmonic frequency in question falls on the operating frequency band of the other network. The construction may further comprise a PIFA that operates in the corresponding operating frequency bands according to the systems.

An advantage of the invention is that a single whip antenna can be used in two desired frequency bands when the antenna is in the pulled-out position. Another advantage of the invention is that when the whip antenna according to the invention is used together with a PIFA, the degradation of the operation of the PIFA caused by the user's hand will not substantially degrade the connection since the whip, too, operates in the operating frequency of the PIFA. A further advantage of the invention is that the manufacturing costs of the construction according to the invention are relatively low.

Figure 3:
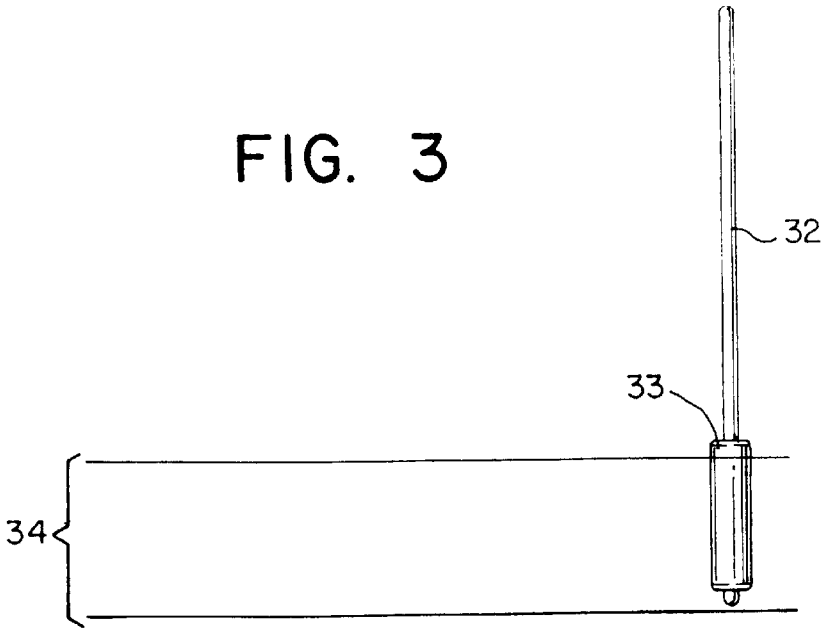
Figure 4:
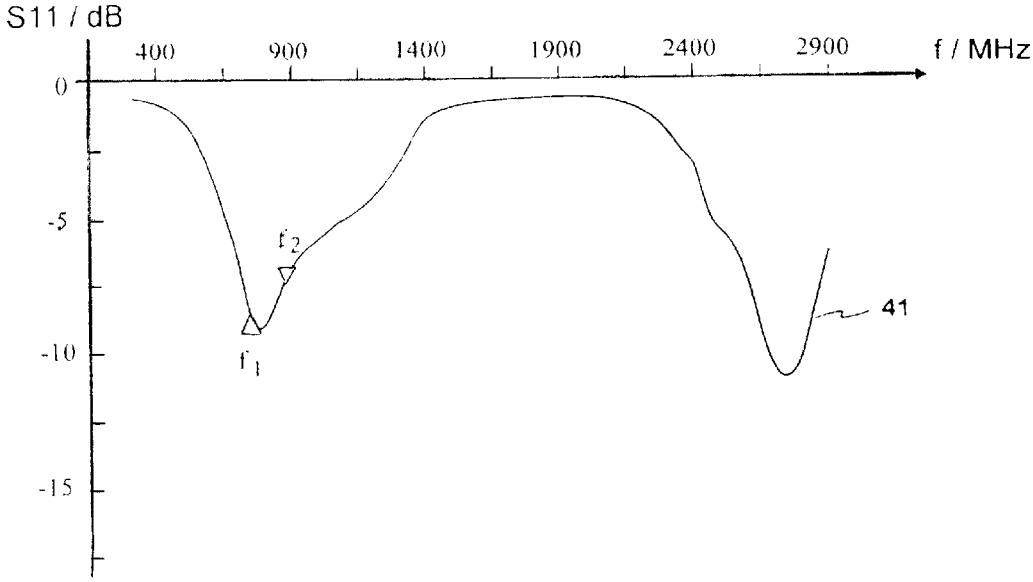
Figure 5:
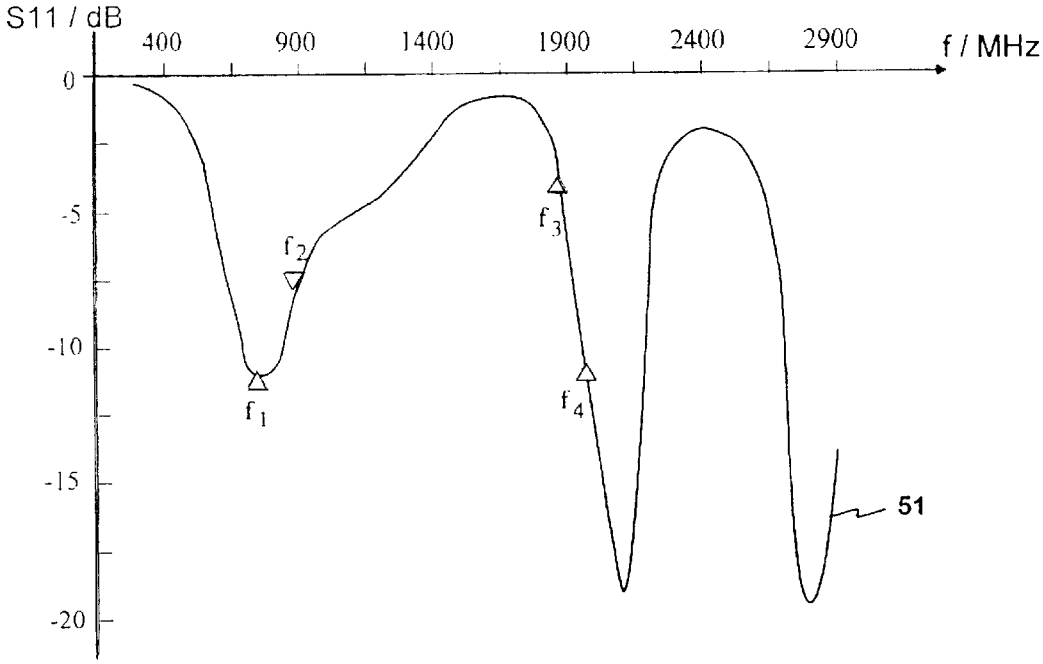

The invention will now be described in detail. Reference will be made to the attached drawing wherein FIG. 1 shows an example of the arrangement according to the invention with one dielectric part in the whip antenna, FIG. 2 shows an example of the arrangement according to the invention with two dielectric parts in the whip antenna, FIG. 3 shows an example of the combination of a whip antenna and PIFA in accordance with the invention, FIG. 4 shows an example of the reflection coefficient of a conventional whip antenna as a function of the frequency, and FIG. 5 shows an example of the reflection coefficient of the whip antenna according to the invention as a function of the frequency.

FIG. 1 shows an example of the whip antenna arrangement according to the invention. It shows a mobile station 11 with its whip antenna 12 in the pulled-out position, said antenna being a quarter-wave antenna. Around the whip antenna, at a location corresponding to the voltage maximum at the first harmonic frequency according to the original dimensions, there is installed a dielectric block 13 shaped like a cylindrical ring. Thus the electrical length of the antenna is increased at the harmonic frequency in question and, consequently, the harmonic resonance frequency is decreased from what it would be without the dielectric block. By choosing the permittivity and dimensions of the dielectric block it is possible to place the operating band corresponding to the harmonic resonance frequency of the antenna at a desired position in the frequency scale.

The amount of change of the frequency of a harmonic is directly proportional to the permittivity of the dielectric block 13 used. The greater the dielectric constant $\in_r$, the greater the change of the frequency of the harmonic. If in FIG. 1 the length of block 13 in the direction of the axis of the antenna is, say, 10 mm and the thickness of the wall is, say, 1 mm, a material may be needed the dielectric constant $\in_r$ of which is several tens. Such values of $\in_r$ can be achieved with various ceramic materials. They, however, have the drawback of being relatively rigid and brittle. Commercial plastic materials which would be suited to being placed around the whip antenna because of their elasticity, have a dielectric constant $\in_r$ of about 10. This value is too low in practice if there is one dielectric block as shown in FIG. 1.

Figure 2:
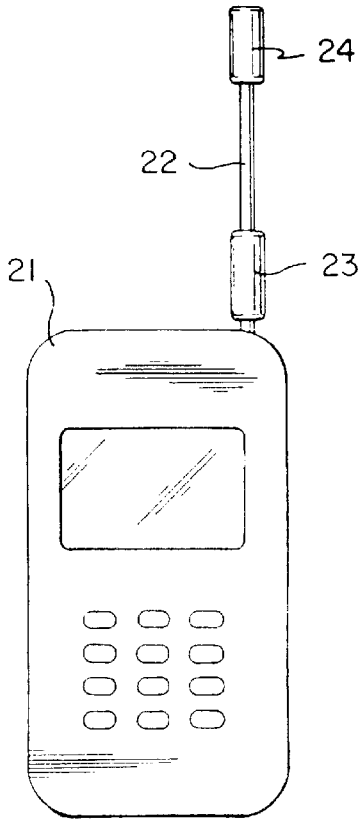

FIG. 2 shows an example of the whip antenna construction according to the invention in which the dielectric material can be plastic even if the harmonic frequency should be shifted a relatively great amount. FIG. 2 shows a mobile station 21 with its whip antenna 22 in the pulled-out position, said antenna being a quarter-wave antenna in this case, too. Around the whip antenna, at a location corresponding to the voltage maximum at the first harmonic frequency according to the original dimensions, there is installed a dielectric block 23 shaped like a cylindrical ring.

At the outer end of the whip antenna there is installed a second dielectric block 24. The first dielectric block 23 is dimensioned such that the voltage maximum at the already-changed harmonic frequency caused by first dielectric block falls on the tip of the whip antenna. As a second dielectric block 24 is installed at said tip, the harmonic frequency in question is further decreased. In the construction depicted in FIG. 2, the $\in_r$ required of the dielectric blocks 23, 24 is not as great as in the construction of FIG. 1. In this preferred embodiment it is possible to use commercial plastics currently available.

The method described above can be extended in accordance with the invention in such a manner that after the two dielectric blocks have been positioned, a new voltage maximum location is searched where a third dielectric block will be positioned. In principle, this can be repeated until the desired operating frequencies have been achieved.

FIG. 3 shows an example of the combination of a whip antenna and PIFA in accordance with the invention. The arrangement comprises a PIFA 34 operating at one or more frequencies, a whip antenna 32 and a dielectric block 33 around the latter. The block 33 is installed in a fixed manner. The whip antenna may be fixed or it may be one that can be pushed inside the communications apparatus, in which case the whip antenna has a first and a second extreme position. If the movable whip is in the pushed-in position, only the PIFA 34 functions as the antenna of the communications apparatus. When the whip antenna is in the pulled-out position, the dielectric block 33 is at a location of the whip antenna where the harmonic resonance frequency of the antenna gets the desired value according to the description of FIG. 1. Thereby the whip antenna functions at two desired frequency bands which are advantageously the same as the operating frequency bands of the PIFA. Thus the whip antenna according to the invention improves the function of the antenna of a mobile phone especially in poor and noisy conditions in which the performance of the PIFA proper becomes insufficient. Furthermore, the degrading effect of the user's hand on the function of the antenna is reduced.

The dielectric block 33 may be placed either below the radiating element of the PIFA, as in FIG. 3, or in its immediate vicinity. As the block 33 is then within the housing of the communications apparatus, its material can be some ceramic substance the $\in_r$ of which is sufficient for the application in question. For clarity, the dielectric block 33 in FIG. 3 as well as blocks 13, 23 and 24 in FIGS. 1 and 2 are drawn thicker than the whip. In practice, however, they are realized such that their thickness equals that of the whip part.

FIG. 4 shows an example of the reflection coefficient of a conventional $\lambda/4$ whip antenna as a function of the frequency. The reflection coefficient S11 is given on the vertical axis in decibels; curve 41 represents its variation. The frequency scale on the horizontal axis extends from 400 to 2900 MHz. At measurement points $f_1$ and $f_2$, which are located in the band 824–894 MHz used by the analog AMPS (Advanced Mobile Phone Service) system, the reflection coefficient is −8.4 dB and −7.4 dB, respectively. These values mean the antenna can be used in the system. Another useable frequency band with the antenna would be around triple basic resonance frequency at 2.7 GHz, approximately. It is, however, of no use. For example, in a PCS cellular network, the operating frequency band of which is 1850–1990 MHz, the antenna would be useless because of mismatch.

FIG. 5 shows by means of curve 51 the reflection coefficient of a $\lambda/4$ whip antenna according to FIG. 1 as a function of the frequency. The whip antenna in this case, too, is originally dimensioned so as to be useable in an AMPS cellular network. The antenna now has a dielectric block such that the harmonic corresponding to the triple basic frequency of the antenna has now dropped somewhere near 2 GHz. At measurement points $f_3$ and $f_4$, which are located in the band used by the PCS network, the reflection coefficient is −3.6 dB and −11.1 dB, respectively. This means that the antenna functions acceptably almost throughout the whole PCS range. In the AMPS range the operation is at least as good as with an antenna corresponding to FIG. 4; at measurement points $f_1$ and $f_2$ the reflection coefficient is −11.0 dB and −7.6 dB.

In accordance with the examples depicted in FIGS. 4 and 5 whip antenna constructions can be realized on the basis of the inventional idea that can be used in frequency bands other than those two mentioned-in said Figures.

Above it was described preferred embodiments of the invention. The invention is not limited to the constructions described above. For example, it is possible to use together with the whip antenna other antenna structures than the PIFA generally used in mobile phones. Moreover, whip antennas can be realized in accordance with the invention that function in more than two operating frequency bands. The inventional idea can be applied in many ways within the scope defined by the claims attached hereto.

What is claimed is:

1. An antenna in a radio apparatus comprising a single radiating element, the single radiating element being a monopole whip antenna for transmitting and receiving radiation in at least two frequency bands, wherein in connection with said monopole whip antenna (12, 22, 32) there is at least one dielectric part (13, 23, 24, 33) that is placed around said monopole whip antenna at a location where there is a voltage maximum at a harmonic of the basic resonating frequency of said monopole whip antenna for changing the electrical length of the monopole whip antenna at said harmonic resonance frequency of said monopole whip antenna.

2. The antenna of claim 1, characterized in that said monopole whip antenna has first and second functional extreme positions, said first functional extreme position being substantially completely pulled out and said second functional extreme position being substantially completely pushed inside the housing of said radio apparatus.

3. The antenna according to claim 1, characterized in that said harmonic of said basic resonating frequency is the third resonating frequency when the basic resonating frequency of said monopole whip antenna is a first resonating frequency.

4. The antenna according to claim 1 with two dielectric parts, characterized in that said at least one dielectric part includes a first dielectric part (23) which is placed around the monopole whip antenna (22) installed in a fixed manner in relation to the frame of the radio apparatus, and a second dielectric part (24) which is installed at the outer end of the monopole whip antenna.

5. The antenna according to claim 1, characterized in that the material of said at least one dielectric part (13,23,24,33) is plastic.

6. The antenna according to claim 1, characterized in that the material of said at least one dielectric part (13,23,24,33) is ceramic.

* * * * *